US006810530B2

(12) United States Patent
Bryant, Sr.

(10) Patent No.: US 6,810,530 B2
(45) Date of Patent: Nov. 2, 2004

(54) CONVERTIBLE GLOVE

(75) Inventor: Frank D. Bryant, Sr., Knoxville, TN (US)

(73) Assignee: Bryant Sales Company, LLC, Knoxville, TN (US)

( * ) Notice: Subject to any disclaimer, the term of this patent is extended or adjusted under 35 U.S.C. 154(b) by 0 days.

(21) Appl. No.: 10/651,339

(22) Filed: Aug. 28, 2003

(65) Prior Publication Data

US 2004/0123371 A1 Jul. 1, 2004

Related U.S. Application Data

(60) Provisional application No. 60/409,351, filed on Sep. 9, 2002.

(51) Int. Cl.[7] ..... A41D 19/00
(52) U.S. Cl. ..... 2/159; 2/158
(58) Field of Search ..... 2/16, 20, 158, 2/159, 160, 161.1, 161.2, 161.6, 162, 163

(56) References Cited

U.S. PATENT DOCUMENTS 2,118,463 A * 5/1938 Eden ..... 2/163
3,299,441 A * 1/1967 Slimovitz ..... 2/158
4,408,358 A * 10/1983 Swan ..... 2/161.1
4,651,350 A * 3/1987 Dawiedczyk ..... 2/158
4,704,743 A * 11/1987 Thornell et al. ..... 2/161.1
4,933,992 A * 6/1990 Kallman ..... 2/160
5,509,143 A * 4/1996 Yates et al. ..... 2/160
5,617,583 A * 4/1997 Yates et al. ..... 2/160
5,680,654 A * 10/1997 McClanahan, II ..... 2/163
6,338,163 B1 * 1/2002 Markson ..... 2/163

OTHER PUBLICATIONS

Simmsfishing Catalog, WindStopper Foldover Mitt, p. 1 (http://www.simmsfishing.com/editable/access_access_wsFoldoverMitt.shtml (1 page).
GLACIERGLOVE Catalog, Galcaier Glove, p. 1 (http://www.glacierglove.com/pages/gloves1.html (1 page).

* cited by examiner

*Primary Examiner*—Gary L. Welch
(74) *Attorney, Agent, or Firm*—Luedeka, Neely & Graham, P.C.

(57) ABSTRACT

A glove with one or more of the thumb and/or finger sleeves open at their distal ends, which includes an integral removable finger and thumb covering system or a removable mitten and thumb covering system that consists of select removable finger and thumb coverings or mitten and thumb coverings respectively, which are connected to an elastic wrist encircling collar with elastic ribbons. The select removable finger and thumb coverings or mitten and thumb coverings are tucked under the wrist-encircling collar when not in use.

16 Claims, 10 Drawing Sheets

CONVERTIBLE GLOVE

This application claims the benefit of U.S. Provisional Application No. 60/409,351, entitled CONVERTIBLE GLOVE filed on Sep. 9, 2002, by Frank D. Bryant, Sr.

FIELD OF THE INVENTION

This invention pertains to a cold weather glove in which the temporary removal of those portions of the glove or mitten that covers and insulates one or more of the fingers and/or the thumb is periodically desirable in order to increase the tactile sensitivity and dexterity of the fingers and/or thumb.

BACKGROUND OF THE INVENTION

Many outdoor activities, particularly, but not limited to, fishing and hunting, take place in cold weather conditions in which it is necessary to wear gloves or mitts in order to keep the hands warm. However, the additional bulk of the glove or mitt, especially those parts of the glove or mitt that cover, encompass, and insulate the fingers and thumb, interfere with the ability to manipulate or operate tools and equipment such as, but not limited to, fishing reels, firearms, tackle cases, etc. Furthermore, accomplishing an otherwise simple task such as tying a lure to a fishing line is rendered virtually impossible by the additional bulk of those parts of the glove or mitten that cover, encompass, and insulate the fingers and thumb.

Various existing glove and mitten designs address this problem in one way or another.

The simplest of these designs, sometimes referred to as "Fingerless" or "¾ Finger" gloves, are typical glove designs that exclude those parts of the glove that cover, encompass, and insulate the fingers and thumb. However, these designs leave the fingers continuously exposed to the cold weather, and sacrifice warmth for increased tactile sensitivity and dexterity of the fingers and/or thumb. (Example of Prior Art: U.S. Pat. No. : 4,408,358 to Swan)

More elegant designs accomplish the temporary exposure of one or more fingers and/or thumb by the means of a "slit" type opening that is usually located on the inner side "palm side" of the major knuckle of the finger and/or thumb. When it is desirable to temporarily expose the fingers and/or thumb, the digit is pushed through said slit opening. (Examples of Prior Art: U.S. Pat. No. : 4,651,350 to Dawiedczyk and U.S. Pat. No. : 3,299,441 to Slimovitz).

At least one design accomplishes the temporary exposure of one or more fingers and/or thumb by the means of a zipper that creates an opening in the side of the finger and/or thumb covering through which the finger and/or thumb is pushed when the zipper is open. (Example of Prior Art: U.S. Pat. No. : 2,118,463 to Eden).

Some designs make no provision for stowing finger and/or thumb coverings and allow the coverings to dangle loose while they are not being used. (Examples of Prior Art: U.S. Pat. No. : 2,118,463 to Eden and U.S. Pat. No. : 3,299,441 to Slimovitz). Other designs provide for stowage of the finger and/or thumb coverings by folding the coverings over the back of the fingers, thumb, and/or hand and attaching them to the back of the fingers, thumb, and/or hand by means of Hook and Loop fasteners. (Examples of Prior Art: U.S. Pat No.: 4,651,350 to Dawiedczyk and U.S. Pat. No. : 6,338,163 to Markson).

Although the above-mentioned designs allow for the ability to temporarily expose one or more fingers and/or the thumb for increased tactile sensitivity and dexterity, there are four critical drawbacks to the basic design. The four drawbacks to the above described glove design are:

One; the "slit" openings on the underside of the fingers and/or thumb coverings allow for continuous exposure of the skin to the outside elements. Therefore, the insulation qualities of the glove are severely compromised even when the coverings of the fingers and/or thumb are in place.

Two; when the coverings of the fingers and/or thumb are folded over the backs of the fingers, and/or thumb they tend to hinder not only the general mobility of the fingers and/or thumb but they also create bulky obstructions on the backs of the fingers and/or thumb that are easily tangled in the various mechanisms and/or parts of the tools and equipment being used. This is particularly true when working with various types of cordage, especially fishing line.

Three; the hook and loop fasteners used to secure the finger and/or thumb coverings to the back of the glove tend to snag and abrade articles of clothing (particularly coat and jacket sleeves) as well as other parts of the glove that may come in contact with the hook and loop fasteners.

Four; the glove must be partially removed from the hand each time the wearer wishes to either expose or cover exposed fingers and/or thumb. This is necessary in order to align the fingers and/or thumb with the slit openings on the bottom side of the finger and/or thumb coverings.

There is a need for a cold weather glove that will allow for the quick and easy temporary exposure of the fingers and/or thumb while overcoming the four critical drawbacks (described above) of current glove designs.

| U.S. Pat. DOCUMENTS | | |
|---|---|---|
| 2,118,463 | 2/1938 | Eden |
| 3,299,441 | 4/1966 | Slimovitz |
| 4,408,358 | 8/1982 | Swan |
| 4,651,350 | 9/1985 | Dawiedczyk |
| 6,338,163 | 9/2000 | Markson |

SUMMARY

The problems with the prior art are solved by providing a glove with a removable finger and thumb covering system or a removable mitten and thumb covering system, which glove includes a collar that encircles the wrist on the outside of the glove at the wrist, elastic ribbons that attach the removable finger and/or thumb coverings or mitten and/or thumb coverings to the collar, and removable finger or mitten and/or thumb coverings. Such covering systems are sometimes referred to herein as a digit covering system, and digit is used as a synonym for either a thumb or a finger.

The proximal edge of the collar is attached to the outside edge of the glove cuff by stitching the proximal edge of the collar to and completely around the outside edge of the glove cuff in such a way that the collar encircles the wrist when the hand is inserted into the body of the glove. The distal edge of the collar remains open to allow removable finger or mitten and/or thumb coverings to be tucked in under the collar.

The removable finger or mitten and/or thumb coverings are attached to the distal edge of the collar with an elastic ribbon material that runs from the distal edge of the collar to the top proximal edge of the finger or mitten and/or thumb covering in such a way as to hold the finger or mitten and/or thumb covering in place over the fingers and/or thumb. The elasticsticity of the elastic ribbon material allows the finger or mitten and/or thumb covering to be donned or doffed without the necessity of partially removing the body of the glove. The elasticsticity of the elastic ribbon material also allows for easy opening and closing of the hand without causing undue restriction and/or binding when the finger or mitten and/or thumb coverings are in place on the fingers and/or thumb.

The removable finger or mitten and/or thumb coverings are designed in such a way that they overlap the fingers and/or thumb openings in the body of the glove and thereby eliminate exposure of any part of the fingers and/or thumb to the outside elements.

Removing the finger or mitten and/or thumb coverings from the fingers and/or thumb is accomplished by simply pulling the finger or mitten and/or thumb coverings off of the fingers and/or thumb. Once removed, the finger or mitten and/or thumb coverings and the elastic ribbon attachments can be tucked under the collar over the back side of the wrist, thus increasing finger and/or thumb dexterity and mobility and eliminating bulky obstructions on the backs of the fingers and/or thumb that can be easily tangled in various mechanisms and/or parts of tools and equipment, is especially cordage and fishing line.

BRIEF DESCRIPTION OF THE DRAWINGS

The foregoing, as well as other objects of the present invention, will be further apparent from the following detailed description of the preferred embodiment of the present invention, when taken together with the accompanying specifications and drawings, in which.

DETAILED DESCRIPTION

Figure 1:
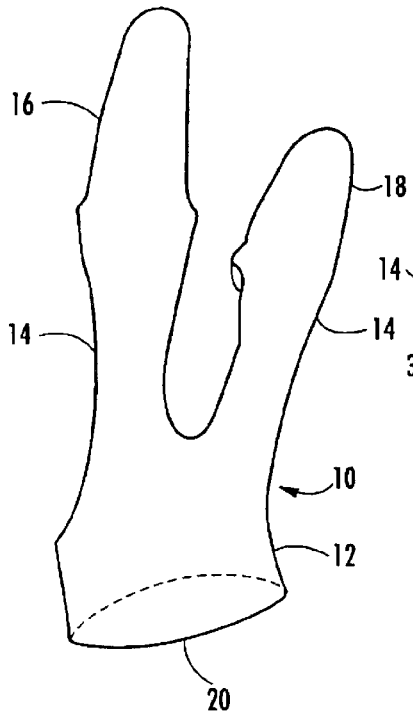
FIG. 1 is a perspective view of the removable finger and thumb covering system constructed in accordance with the present invention.

The accompanying drawings and the description, which follows, set forth this invention in its preferred embodiment. However, it is contemplated that persons generally familiar with gloves and mittens will be able to apply the novel characteristics of the structures illustrated and described herein in other contexts by modification of certain details. Accordingly, the drawings and description are not to be taken as restrictive on the scope of this invention, but are to be understood, instead, as broad and general teachings.

Referring now to the drawings in detail, wherein like reference characters represent like elements of features throughout the various views, the present invention is indicated generally in the figures by reference character 10.

Turning to FIG. 1, the removable finger and thumb covering system 10 includes an elastic collar, band, belt, or strap constructed of rubber, vinyl, woven elastic fabric, knit elastic fabric, or some other stretchable or elastomeric material. In the preferred embodiment, collar 12 is preferably of neoprene sponge construction, having a nylon tricot knit laminated to one side. As shown in FIG. 1, removable finger and thumb covering system 10 also includes elastic ribbons or straps constructed of rubber, vinyl, woven elastic fabric, knit elastic fabric, or some other stretchable or elastomeric material. In the preferred embodiment, elastic ribbons 14 are preferably of neoprene sponge construction, having a nylon tricot knit laminated to one side. As shown in FIG. 1, removable finger and thumb covering system 10 also includes an index finger covering 16 and a thumb covering 18 constructed of any woven, knitted, or felted fabric that provides insulation for the index finger and thumb. In the preferred embodiment, index finger covering 16 and thumb covering 18 are preferably of neoprene sponge construction, having a nylon tricot knit laminated to one side. The removable finger and thumb covering system 10 is attached to the glove body 30 by stitching the proximal edge 20 of the collar 12 to the outside edge of the glove cuff 22 in such a way that the collar encircles the wrist when the hand is inserted into the body of the glove. The distal edge 28 of the collar 12 remains open to allow removable index finger covering 16, the removable thumb covering 18, and the elastic ribbons 14 to be tucked under the distal edge 28 of the collar 12 at the back of the wrist.

Figure 2:
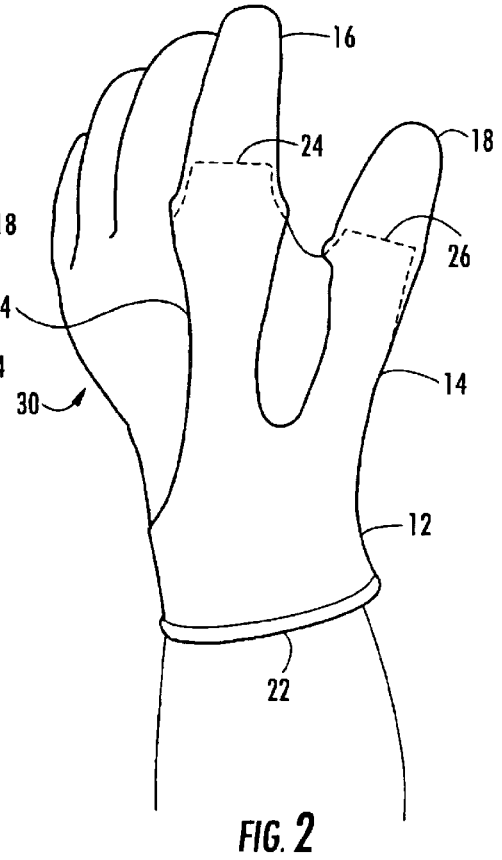
FIG. 2 is a back elevational view of a glove having a removable finger and thumb covering system, illustrating a removable index finger covering and a removable thumb covering in place over the index finger and thumb, constructed in accordance with the present invention.
Figure 3:
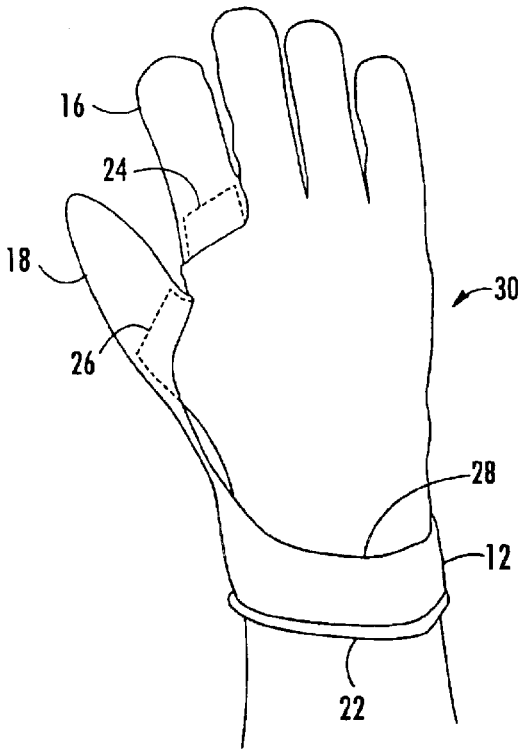
FIG. 3 is a front elevational view of a glove having a removable finger and thumb covering system, illustrating a removable index finger covering and a thumb covering in place over the index finger and thumb, constructed in accordance with the present invention.

FIG. 2 and FIG. 3 illustrate the removable finger and thumb covering system 10 attached to a glove 30 by stitching the proximal edge 20 of the collar 12 to and completely around the outside edge of the glove 30 cuff 22 in such a way that the collar 12 encircles the wrist when the hand is inserted into the body of the glove 30. The distal edge 28 of the collar 12 remains open to allow the removable index finger covering 16 and the removable thumb covering 18 to be tucked in under the collar 12. FIG. 2 and FIG. 3 also illustrate the removable index finger covering 16 and the removable thumb covering 18 being held in place and completely covering the index finger and thumb by the elastic ribbons 14 that join the removable index finger covering 16 and the removable thumb covering 18 to the distal edge 28 of the collar 12. FIG. 2 and FIG. 3 also illustrate how the removable index finger covering 16 and the removable thumb covering 18 overlap and completely cover the index finger opening 24 and the thumb opening 26 in the glove 30.

Figure 4:
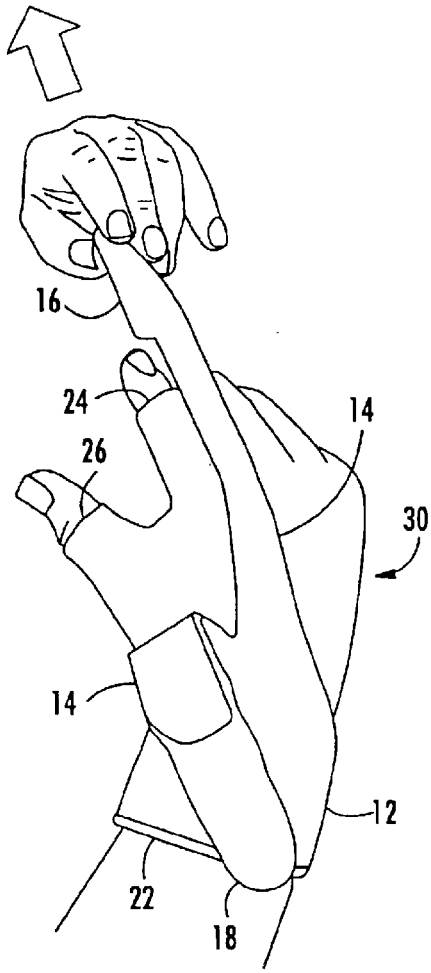
FIG. 4 is a back elevational view of a glove having removable finger and thumb covering system, illustrating a removable index finger covering that is in the process of being doffed or donned, constructed in accordance with the present invention.

FIG. 4 illustrates the process of doffing or donning the index finger covering 16 without the necessity of partially removing the hand from the glove 30. Grasping the removable index finger covering 16 and pulling the removable index finger covering 16 away from the wrist stretches the elastic ribbon 14 and allows the removable index finger covering 16 to be removed from or placed over the index finger, which is protruding through the index finger opening 24 in the glove 30. FIG. 4 illustrates the thumb exposed through the thumb opening 26 while the removable thumb covering 18 is dangling from the collar 12 by the elastic ribbon 14.

Figure 5:
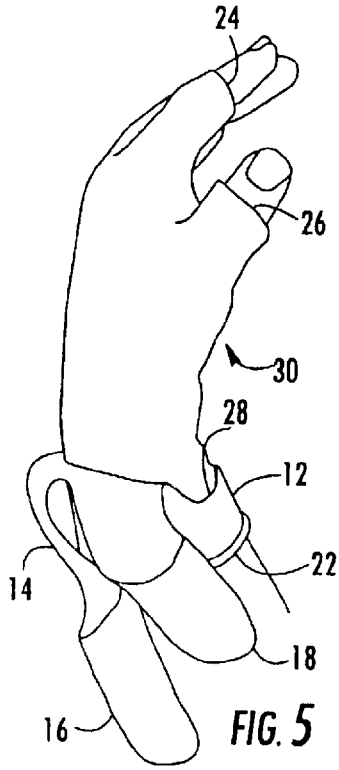
FIG. 5 is a side elevational view of a glove having removable finger and thumb covering system, illustrating a removable index finger covering and a removable thumb covering that have been removed from the index finger and thumb, constructed in accordance with the present invention.

FIG. 5 illustrates the index finger exposed through the index finger opening 24 of the glove 30 and the thumb exposed through the thumb opening 26 of the glove 30, while the removable index finger covering 16 and the removable thumb covering 18 are dangling from the collar 12 by the elastic ribbon 14.

Figure 6:
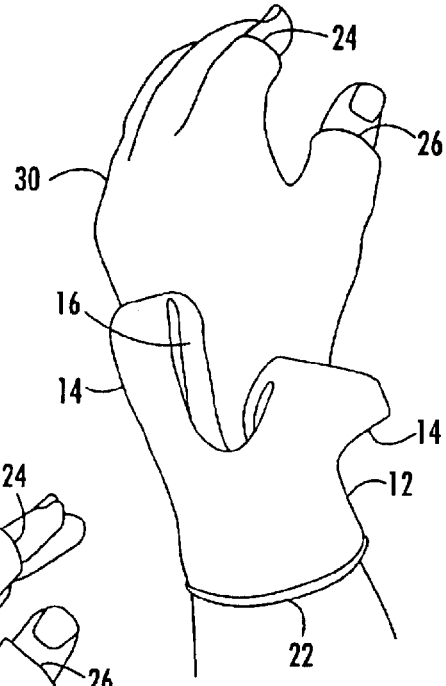
FIG. 6 is a back elevational view of a glove having a removable finger and thumb covering system, illustrating a removable index finger covering and a removable thumb covering that have been removed from the index finger and thumb and that have been partially tucked under the collar at the back of the wrist, constructed in accordance with the present invention.

FIG. 6 illustrates the index finger exposed through the index finger opening 24 of the glove 30 and the thumb exposed through the thumb opening 26 of the glove 30, while the removable index finger covering 16 and the removable thumb covering 18 are partially tucked under the distal edge 28 of the collar 12 at the back of the wrist.

Figure 7:
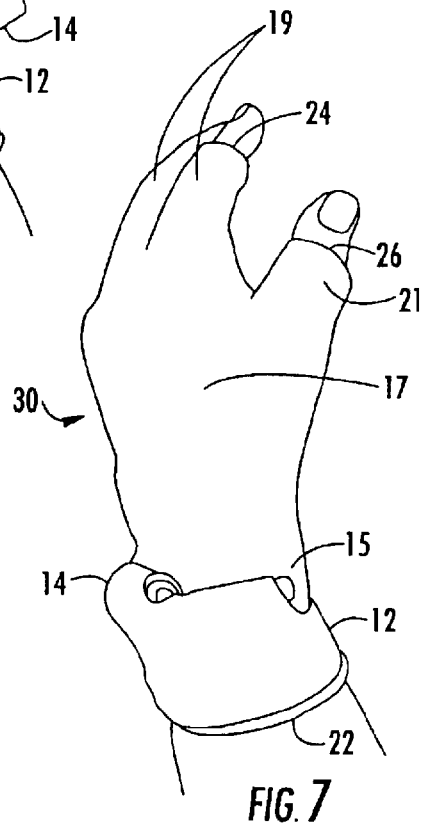
FIG. 7 is a back elevational view of a glove having a removable finger and thumb covering system, illustrating a removable index finger covering and a removable thumb covering that have been removed from the index finger and thumb and that have been completely tucked under the collar at the back of the wrist, constructed in accordance with the present invention.

FIG. 7 illustrates the index finger exposed through the index finger opening 24 of the glove 30 and the thumb exposed through the thumb opening 26 of the glove 30, while the removable index finger covering 16 and the removable thumb covering 18 are completely tucked under the distal edge 28 of the collar 12 and securely stowed away from the fingers and thumb under the collar 12 at the back of the wrist. As shown in the figure, the glove 30 includes a tubular cuff sleeve 15 that covers the wrist, a tubular palm sleeve 17 that covers the palm and backside of the hand, tubular finger sleeves 19 that fit over the fingers and a thumb sleeve 21 that fits over a thumb.

In an alternate embodiment, only one covering, such as covering 18, may be provided, and such single covering is preferably configured to cover all exposed fingers and the thumb. Another embodiment of the invention, shown in FIGS. 8–14 involves a removable mitten and thumb covering system 50, which allows for the exposure of all of the fingers by folding back only one mitten covering. This system may be preferable to the above described embodiment in activities requiring sensitive tactile feeling from all the fingers on the hand as opposed to only one finger and the thumb. The removable mitten and thumb embodiment described below closely resembles the removable finger and thumb embodiment described above and thus the descriptions are nearly parallel.

Polyester Micro Fleece with PU Membrane in between.

Figure 8:
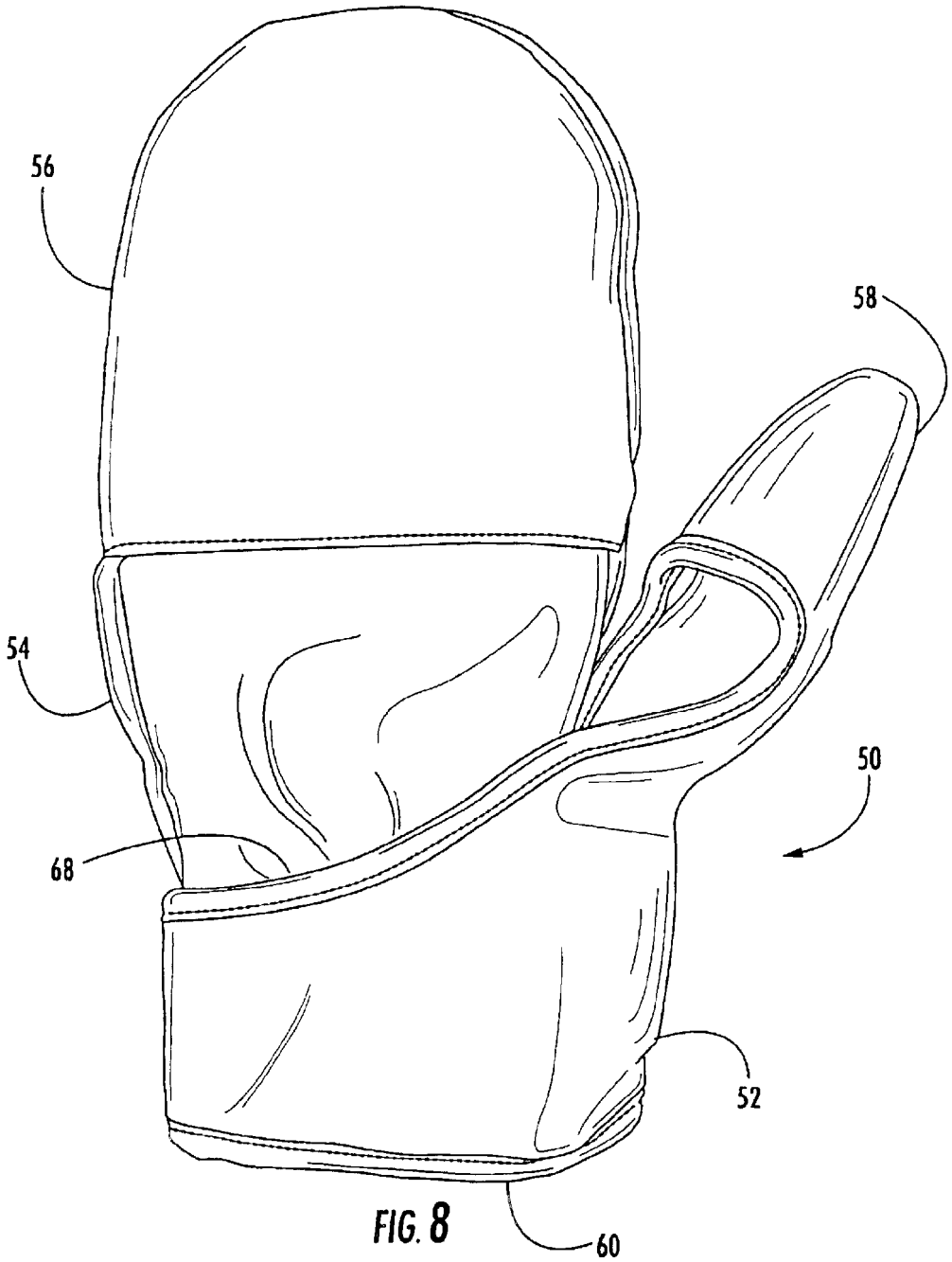
FIG. 8 is a perspective view of the removable mitten and thumb covering system constructed in accordance with the present invention.

Turning now to FIG. 8, the removable mitten and thumb covering system 50 includes an elastic collar, band, belt, or strap (such as collar 52) constructed of rubber, vinyl, woven elastic fabric, knit elastic fabric, or some other stretchable or elastomeric material. The collar 52 is preferably of neoprene sponge construction, having a nylon tricot knit laminated to one side. The removable mitten and thumb covering system 50 also includes a mitten covering 56 and a thumb covering 58 constructed of woven, knitted, or felted fabric that provides insulation for the fingers and thumb. In one embodiment, the mitten covering 56 and the thumb covering 58 are of neoprene sponge construction, having a nylon tricot knit laminated to one side. In an alternate embodiment, the mitten covering is constructed of a laminate with polyester micro fleece layers on the outside and inside with PU Membrane in between the microfleece layers.

The removable mitten and thumb covering system 50 is attached to the glove body 70 by stitching the proximal edge 60 of the collar 52 to the outside edge of the glove cuff 62 in such a way that the collar encircles the wrist when the hand is inserted into the body of the glove. The exposed edges of the thumb covering 58, the mitten covering 56 and the collar 52 are covered by elastic piping 54. The piping 54 is preferably nylon/lycra tape.

The distal edge 68 of the collar 52 remains open to allow the removable mitten covering 56, the removable thumb covering 58, and the elastic piping 54 to be tucked under the distal edge 68 of the collar 52 at the back of the wrist.

Figure 9:
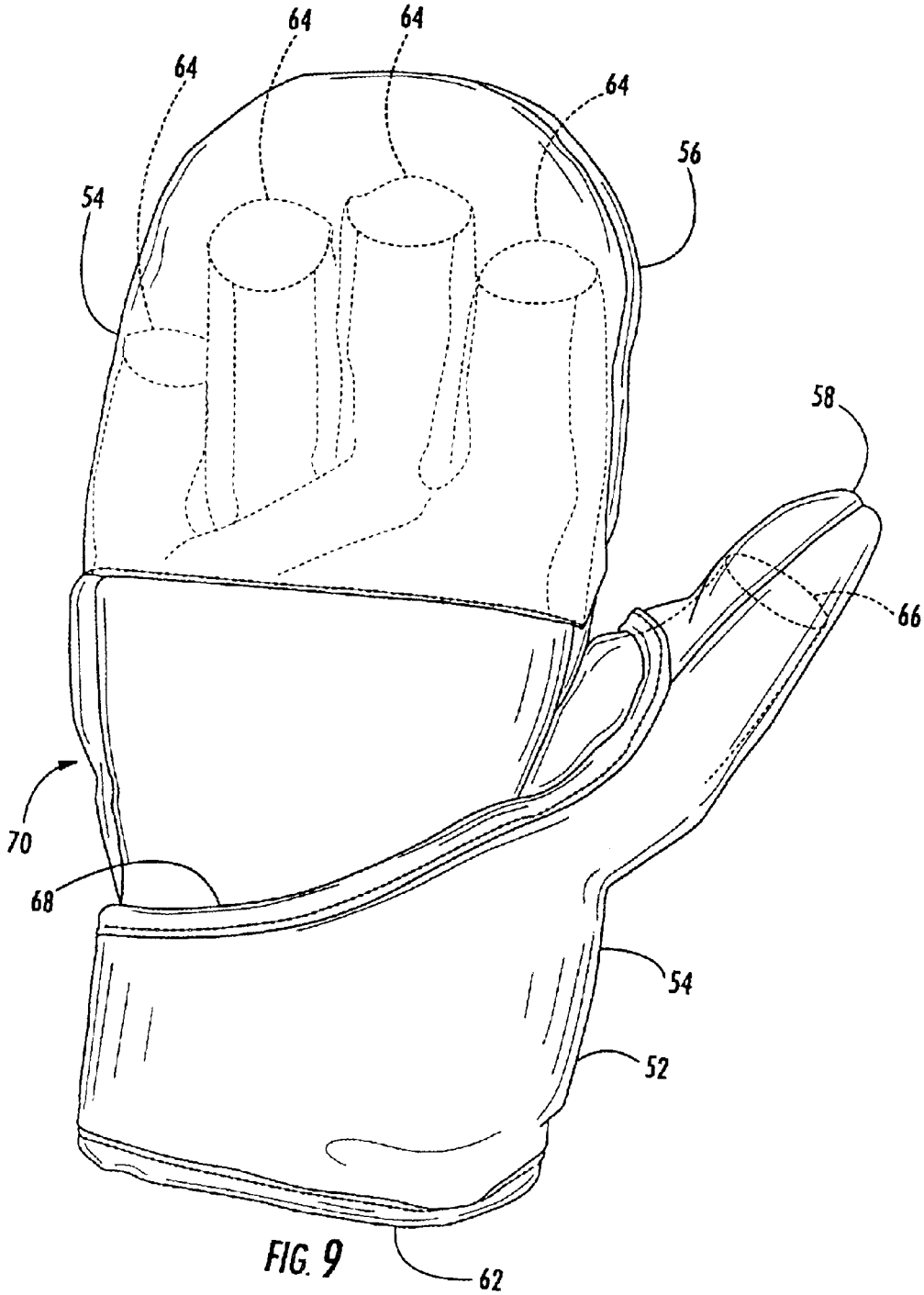
FIG. 9 is a back elevational view of a glove having a removable mitten and thumb covering system, illustrating a removable mitten covering and a removable thumb covering in place over the fingers and thumb, constructed in accordance with the present invention.
Figure 10:
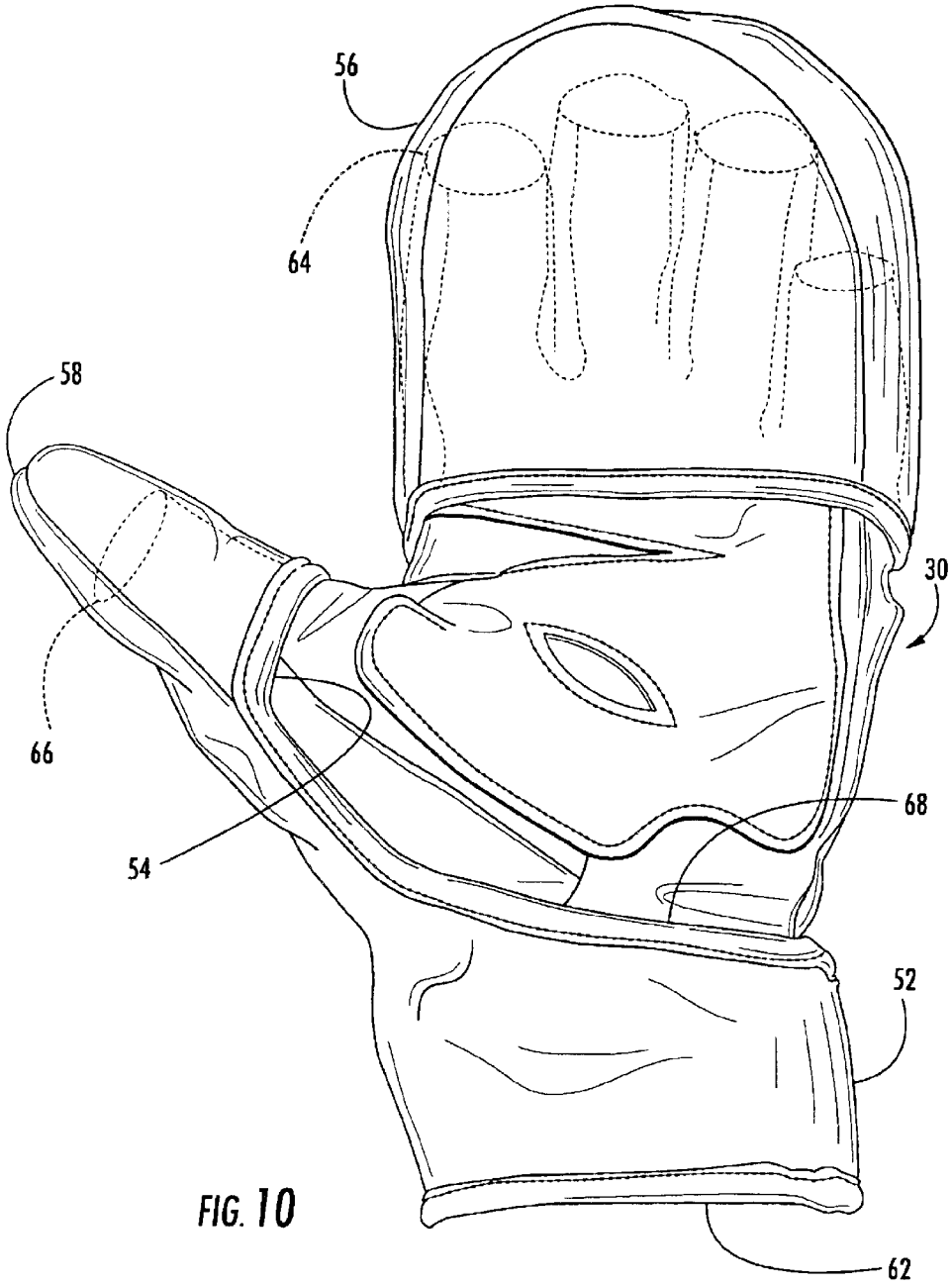
FIG. 10 is a front elevational view of a glove having a removable mitten and thumb covering system, illustrating a removable mitten covering and a thumb covering in place over the fingers and thumb, constructed in accordance with the present invention.

FIGS. 9 and 10 illustrate the removable mitten and thumb covering system 50 attached to a glove 70 by stitching the proximal edge 60 of the collar 52 to and completely around the outside edge of the cuff 62 of glove 70 in such a way that the collar 52 encircles the wrist when the hand is inserted into the body of the glove 70. The distal edge 68 of the collar 52 remains open to allow the removable mitten covering 56 and the removable thumb covering 58 to be tucked in under the collar 52. FIGS. 9 and 10 also illustrate the removable mitten covering 56 and the removable thumb covering 58 being held in place and completely covering the fingers and the thumb. FIGS. 9 and 10 also illustrate how the removable mitten covering 56 and the removable thumb covering 58 overlap and completely cover the finger openings 64 and the thumb opening 66 in the glove 70.

Figure 11:
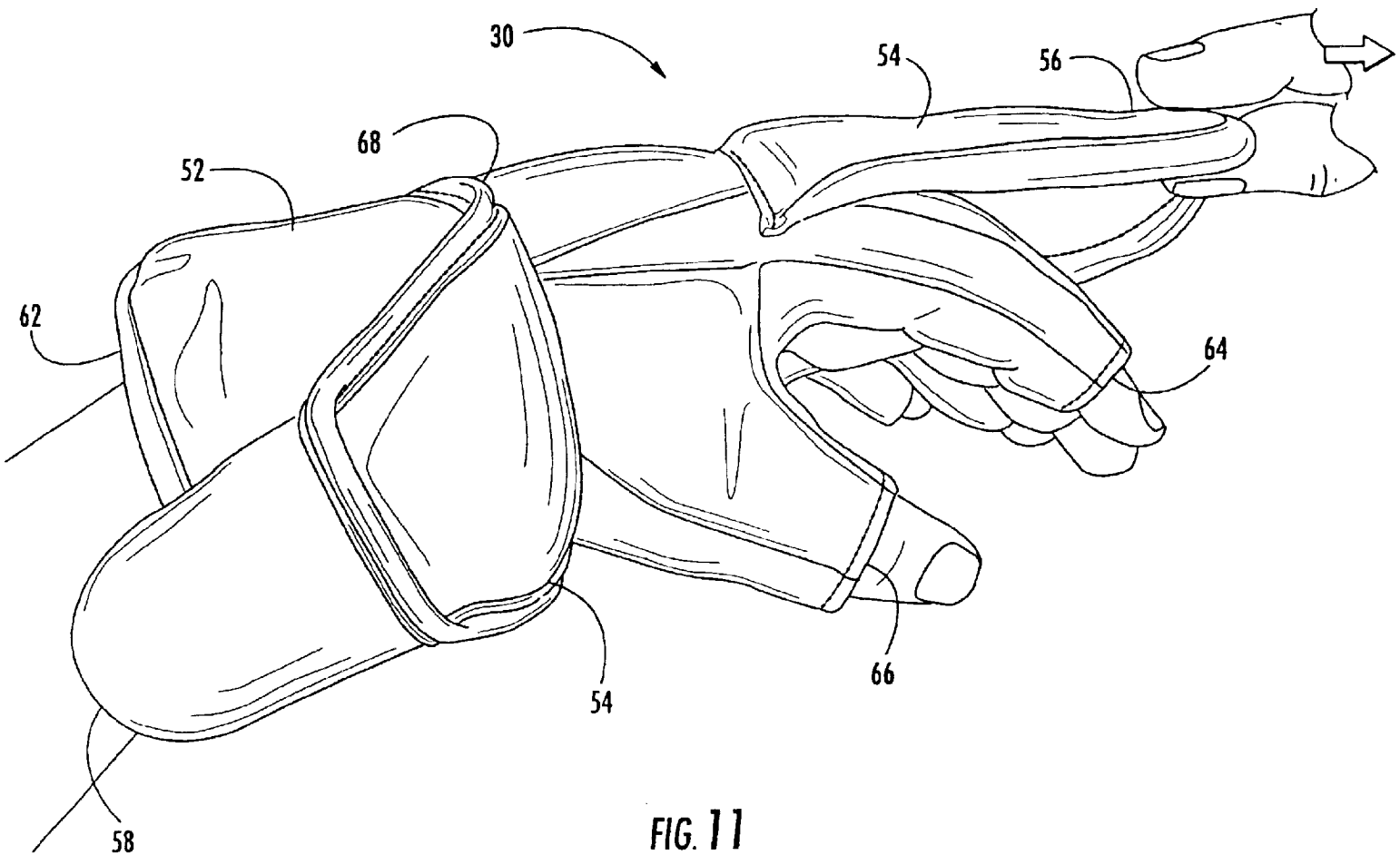
FIG. 11 is a back elevational view of a glove having removable mitten and thumb covering system, illustrating a removable mitten covering that is in the process of being doffed or donned, constructed in accordance with the present invention.

FIG. 11 illustrates the process of doffing or donning the mitten covering 56 without the necessity of partially removing the hand from the glove 70. Grasping the removable mitten covering 56 and pulling the removable mitten covering 56 away from the wrist stretches the elastic mitten covering 56 and elastic piping 54 which allows the mitten covering 56 to be removed from or placed over the fingers that are protruding through the finger openings 64 in the glove 70. FIG. 11 shows the thumb exposed through the thumb opening 66 while the removable thumb covering 58 is dangling from the collar 52.

Figure 12:
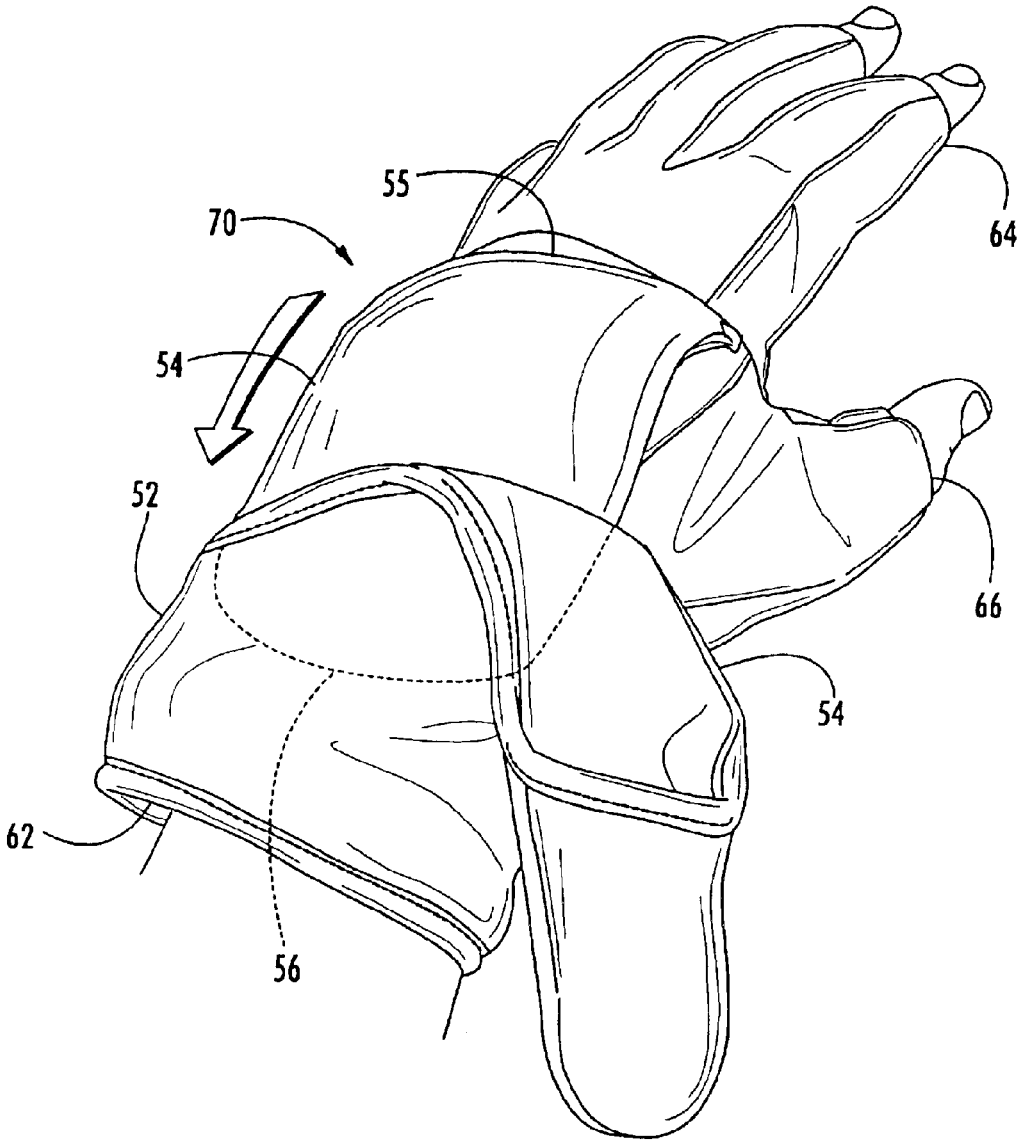
FIG. 12 is a side elevational view of a glove having removable mitten and thumb covering system, illustrating a removable mitten covering and a removable thumb covering that have been removed from the fingers and thumb, constructed in accordance with the present invention.

FIG. 12 illustrates the fingers exposed through the finger openings 64 of the glove 70 and the thumb exposed through the thumb opening 66 of the glove 70, while the removable mitten covering 56 in dangling from the upper wrist edge 55 of the glove 70, and the removable thumb covering 58 is dangling from the collar 52. In this view, the mitten covering 54 has been inserted beneath the elastic collar 52 at the back of the wrist.

Figure 13:
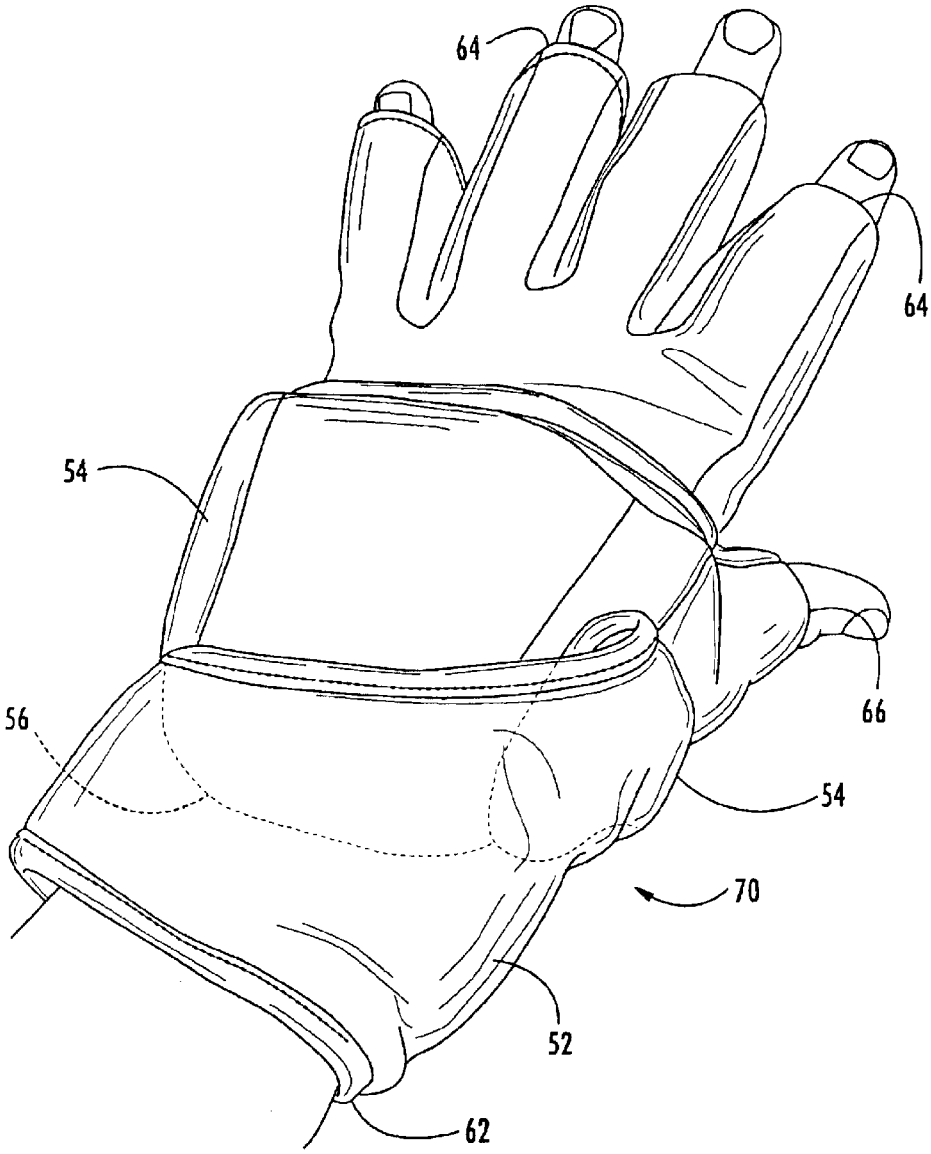
FIG. 13 is a back elevational view of a glove having a removable mitten and thumb covering system, illustrating a removable mitten covering and a removable thumb covering that have been removed from the fingers and thumb and that have been partially tucked under the collar at the back of the wrist, constructed in accordance with the present invention.

FIG. 13 illustrates the fingers exposed through the finger openings 64 of the glove 70 and the thumb exposed through the thumb opening 66 of the glove 70, while the removable mitten covering 56 and the removable thumb covering 58 are partially tucked under the distal edge 68 of the collar 52 at the back of the wrist. The tucked removable thumb covering 58 is overlapped against the tucked removable mitten covering 54 and therefore serves to hold the tucked coverings 54 and 58 in a tucked position. The overlap of the coverings 54 and 58 inside the collar 52 stretches the collar 52 and produces tension that helps to hold the coverings 54 and 58 in a tucked position.

Figure 14:
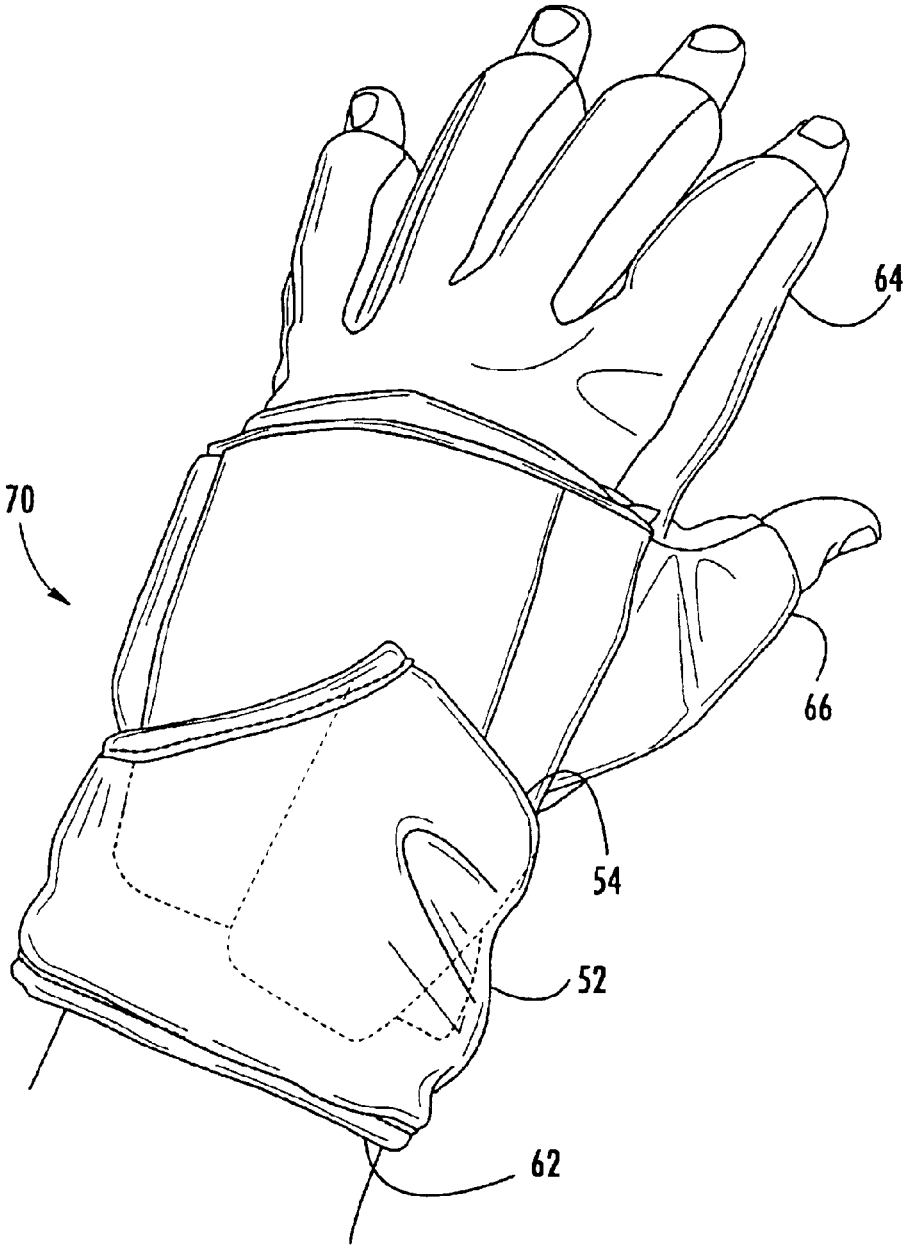
FIG. 14 is a back elevational view of a glove having a removable mitten and thumb covering system, illustrating a removable mitten covering and a removable thumb covering that have been removed from the fingers and thumb and that have been completely tucked under the collar at the back of the wrist, constructed in accordance with the present invention.

FIG. 14 illustrates the fingers exposed through the finger opening 64 of the glove 70 and the thumb exposed through the thumb opening 66 of the glove 70, while the removable mitten covering 56 and the removable thumb covering 58 are completely tucked under the distal edge 68 of the collar 52 at the back of the wrist. The removable thumb covering is folded twice to arrive at this position which provides even more pressure than the positioning shown in FIG. 13 and thus the coverings 54 and 58 are less likely to inadvertently become undocked.

While preferred embodiments of the invention have been described using specific terms, such description is for the present illustrative purposes only, and it is to be understood that changes and variations to such embodiments, including, but not limited to, the substitution of equivalent features or parts, may be practiced by those of ordinary skill in the art without departing from the spirit or scope of the following claims.

What is claimed is:

1. A glove for being worn on the hand of a user, the hand having a wrist, a back of the hand, a palm, and digits in the form of a thumb and four fingers, comprising:

a. A tubular palm sleeve having a proximal end and a distal end and being dimensioned to cover the palm and back of the hand, b. A tubular cuff sleeve disposed at the proximal end of the palm sleeve dimensioned to cover the wrist, c. A tubular thumb sleeve having a proximal end and a distal end, the thumb sleeve being disposed at the distal end of the palm, d. Four tubular finger sleeves, each having a proximal end and a distal end, the four finger sleeves being disposed at the distal end of the palm sleeve and being dimensioned to fit over the four fingers of the user, e. The tubular thumb sleeve and one or more of the tubular finger sleeves being configured with at least one open distal end allowing at least one of the digits of the hand to extend out of at least one of the thumb sleeve and the finger sleeves, f. A removable digit covering system comprising:

i. An elastic collar attached to the glove and being disposed adjacent the cuff sleeve for forming a pocket beneath the collar adjacent the back of the hand, ii. one or more tubular digit coverings that are enclosed at their distal ends and are configured for covering at least one digit, the tubular digit coverings being disposed and dimensioned for fitting in the pocket beneath the elastic collar when not covering the digits.

2. The glove of claim 1 wherein selected tubular digit sleeves are closed at the distal ends.

3. The glove of claim 1 wherein selected tubular digit sleeves are open at the distal ends and are configured and dimensioned to allow a finger or a thumb to extend through the open distal ends.

4. The glove of claim 3 wherein the position, size and shape of the one or more digit coverings correspond to the selected tubular digit sleeves that are open at the distal ends.

5. The glove of claim 1 wherein the distal edge of the collar encircles the cuff sleeve at the wrist area of the glove and is open and unattached to the glove.

6. The glove of claim 5 wherein the selected digit coverings are configured for being tucked under the open distal edge of the collar at the back of the wrist area of the glove.

7. The glove of claim 1 wherein the one or more digit coverings comprise a thumb covering and at least one finger covering, the thumb and finger coverings being integrally formed.

8. The glove of claim 1 wherein the one or more digit coverings comprises a mitten covering for covering more than one digit of the hand.

9. The glove of claim 1 wherein the one or more digit coverings comprises a mitten for covering all of the fingers of the hand.

10. The glove of claim 1 wherein the one or more digit coverings comprises a mitten attached to the glove adjacent the proximal ends of the finger sleeves, the mitten being configured for covering all of the fingers of the hand and for fitting in the pocket formed by the collar.

11. A glove for being worn on the hand of a user, the hand having a wrist, a back of the hand, a palm, and digits in the form of a thumb and four fingers, comprising:

a. A tubular palm sleeve having a proximal end and a distal end and being dimensioned to cover the palm and back of the hand, b. A tubular cuff sleeve disposed at the proximal end of the palm sleeve dimensioned to cover the wrist, c. A removable digit covering system comprising:

i. An elastic collar attached to the glove and being disposed adjacent the cuff sleeve for forming a pocket beneath the collar adjacent the back of the hand, ii. At least one digit covering configured for covering at least one digit, the digit covering being disposed and dimensioned for fitting in the pocket beneath the elastic collar when not covering the digits.

12. The glove of claim 11 wherein the at least one digit covering is a mitten attached to the palm sleeve.

13. The glove of claim 11 wherein the at least one digit covering is dimensioned to cover one digit of the hand and is attached to the sleeve.

14. The glove of claim 11 wherein the at least one digit covering is two separate digit coverings, each of the two separate digit coverings being dimensioned to cover one digit and each of the two separate digit coverings being attached to the collar.

15. The glove of claim 11 wherein the at least one digit covering is a mitten attached to the palm sleeve, the mitten being configured to cover the fingers, and a thumb covering attached to the collar and being dimensioned to cover the thumb.

16. The glove of claim 11 wherein the at least one digit covering is a finger covering attached to the collar and being configured to cover a finger, and a thumb covering attached to the collar and being dimensioned to cover the thumb, said finger covering and thumb covering being integrally formed.

* * * * *